US006435820B1

(12) United States Patent
Overberg

(10) Patent No.: US 6,435,820 B1
(45) Date of Patent: Aug. 20, 2002

(54) SHROUD ASSEMBLY HAVING C-CLIP RETAINER

(75) Inventor: John H. Overberg, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/383,132

(22) Filed: Aug. 25, 1999

(51) Int. Cl.[7] ..... F01D 11/08; F01D 11/18

(52) U.S. Cl. ..... 415/138; 415/173.1; 415/173.3; 415/139; 415/1

(58) Field of Search ..... 415/138, 1, 115, 415/116, 173.1, 173.3, 173.4, 173.5, 139

(56) References Cited

U.S. PATENT DOCUMENTS 5,127,793 A * 7/1992 Walker et al. ..... 415/173.1
5,562,408 A * 10/1996 Proctor et al. ..... 415/173.1
5,669,757 A * 9/1997 Brackett ..... 415/209.2
5,970,716 A * 10/1999 Forrester et al. ..... 60/39.32
6,200,091 B1 * 3/2001 Bromann et al. ..... 415/173.1

* cited by examiner

*Primary Examiner*—Edward K. Look
*Assistant Examiner*—Richard Woo
(74) *Attorney, Agent, or Firm*—Rodney M. Young; Pierce Atwood

(57) ABSTRACT

Disengagement of the C-clip in turbine shroud assemblies is prevented by providing a C-clip retainer. The shroud assembly includes a shroud support having a hook and at least one shroud having a mounting flange. A C-clip overlaps the hook and the mounting flange to clamp the shroud to the shroud support, and the retainer is secured to the shroud support and located so as to engage the C-clip. The retainer engages the C-clip in such a manner so as to limit aft axial movement of the C-clip, thereby eliminating C-clip back-off.

34 Claims, 3 Drawing Sheets

SHROUD ASSEMBLY HAVING C-CLIP RETAINER

STATEMENT REGARDING FEDERALLY SPONSORED RESEARCH & DEVELOPMENT

The U.S. Government may have certain rights in this invention pursuant to contract numbers F33657-95-C0055 and F33657-97-C-0016 awarded by the Department of the Air Force.

BACKGROUND OF THE INVENTION

This invention relates generally to gas turbine engines and more particularly to shroud assemblies utilized in the high pressure turbine section of such engines.

A gas turbine engine includes a compressor that provides pressurized air to a combustor wherein the air is mixed with fuel and ignited for generating hot combustion gases. These gases flow downstream to one or more turbines that extract energy therefrom to power the compressor and provide useful work such as powering an aircraft in flight. A turbine section commonly includes a stationary turbine nozzle disposed at the outlet of the combustor for channeling combustion gases into a turbine rotor disposed downstream thereof. The turbine rotor includes a plurality of circumferentially spaced apart fan blades extending radially outwardly from a rotor disk that rotates about the centerline axis of the engine.

The turbine section further includes a shroud assembly located immediately downstream of the turbine nozzle. The shroud assembly closely surrounds the turbine rotor and thus defines the outer boundary for the hot combustion gases flowing through the turbine. A typical shroud assembly comprises a shroud support which is fastened to the engine outer case and which in turn supports a plurality of shrouds. The shrouds are held in place, in part, by arcuate retaining members commonly referred to as C-clips. Specifically, the C-lips hold the aft end of the shrouds in place against the shroud hangers via an interference fit.

The interference fit normally provides excellent retention of the shrouds. However, there can be a tendency for the C-clips to back off in some instances because of a thermal ratcheting phenomenon. That is, although the shrouds and C-clips are segmented to accommodate for thermal expansion, there is a possibility that the thermal loads within the shroud assembly can overcome the interference fit clamp loads. In some cases, there may be enough of a gap between the C-clip aft face and the adjacent nozzle outer band to allow for C-clip disengagement. Such disengagement could result in severe hardware damage.

Accordingly, there is a need for a shroud assembly design that eliminates C-clip back-off.

SUMMARY OF THE INVENTION

The above-mentioned needs are met by the present invention which provides a shroud assembly including a shroud support having a hook and at least one shroud having a mounting flange. A C-clip overlaps the hook and the mounting flange to clamp the shroud to the shroud support, and a retainer is secured to the shroud support and located so as to engage the Clip. The retainer engages the C-clip in such a manner so as to limit aft axial movement of the C-clip, thereby eliminating C-clip back-off.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
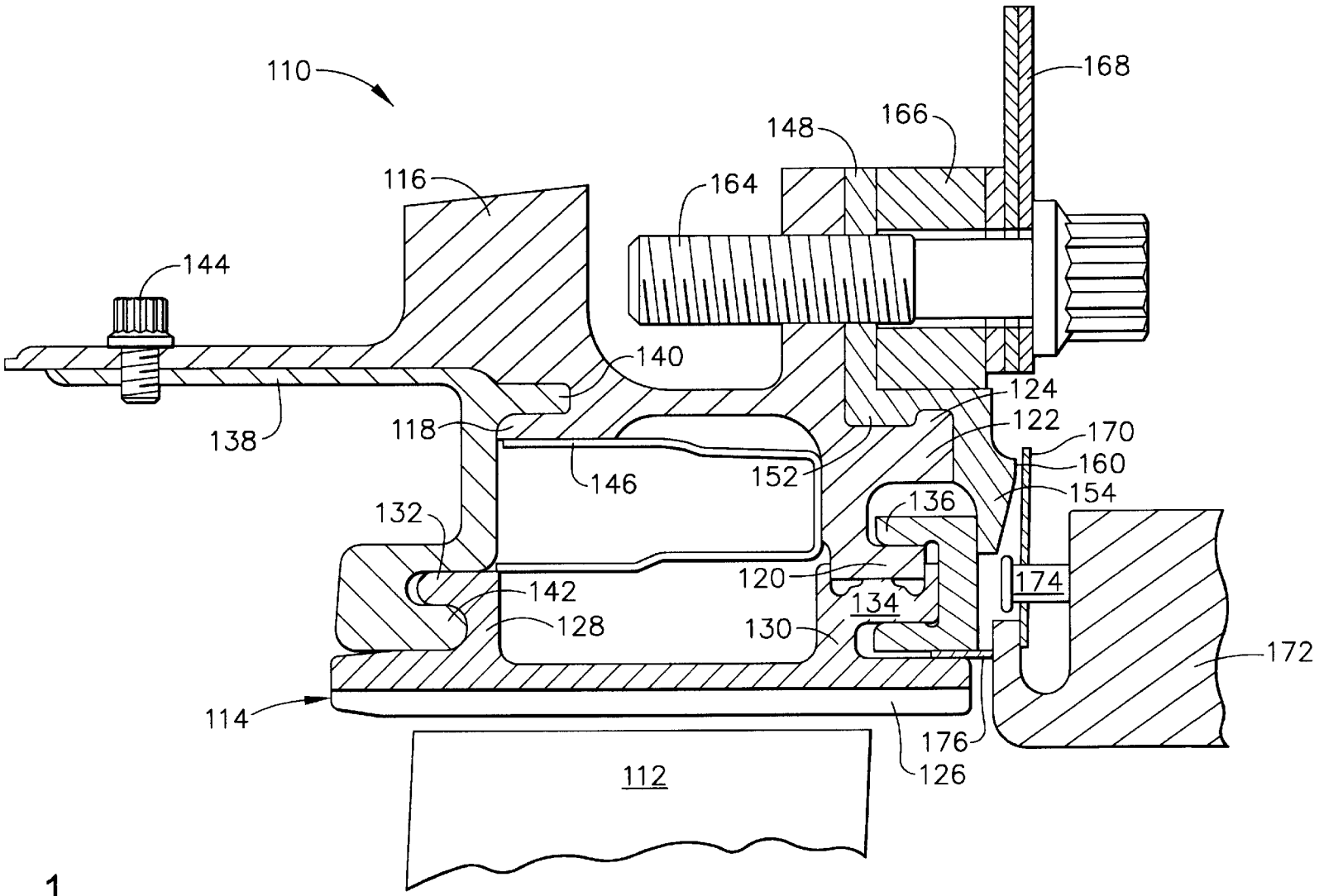
FIG. 1 is an axial sectional view of the shroud assembly of the present invention.

Referring to the drawings wherein identical reference numerals denote the same elements throughout the various views, FIG. 1 shows a shroud assembly 110 of the present invention in closely surrounding relation with turbine blades 112 carried by a rotor disk (not shown) in the high pressure turbine section of a gas turbine engine. The shroud assembly 110 includes a plurality of arcuate shrouds 114 (only one shown in FIG. 1) arranged in an annular array so as to encircle the turbine blades 112. The shrouds 114 are held in position by a shroud support 116 which, in turn, is supported by the engine outer case (not shown) in a conventional manner.

The shroud support 116 includes an axially extending forward hook 118 and an axially extending aft hook 120. The shroud support 116 also includes an axially extending aft flange 122 disposed at a location radially outside of the aft hook 120. A radially outwardly extending lip 124 is formed on the distal end of the aft flange 122. Each shroud 114 includes a base 126 having radially outwardly extending forward and aft rails 128 and 130, respectively. A forward mounting flange 132 extends forwardly from the forward rail 128 of each shroud 114, and an aft mounting flange 134 extends rearwardly from the aft rail 130 of each shroud 114. The aft mounting flanges 134 of each shroud 114 are juxtaposed with the aft hook 120 of the shroud support 116 and are held in place by a plurality of retaining members 136 commonly referred to as C-clips.

The C-clips 136 are arcuate members having a C-shaped cross section and snugly overlap the aft mounting flanges 134 and the aft hook 120 so as to clamp the aft ends of the shrouds 114 in place against the shroud support 116. Although they could be formed as a single continuous ring, the C-clips 136 are preferably segmented to accommodate thermal expansion. Typically, one C-clip 136 clamps an entire shroud plus one-half of each adjacent shroud. In which case, there are twice as many shrouds 114 as there are C-clips 136.

The forward end of each shroud 114 is supported from the shroud support 116 via conventional shroud hangers 138. Each shroud hanger 138 includes a first hook 140 that engages the forward hook 118 of the shroud support 116 and a second hook 142 that engages the forward mounting flange 132 of each shroud 114.

The shroud hangers 138 are also secured to the shroud support 116 by fasteners 144. A conventional cooling air distributor 146 is disposed between the shroud 114 and the shroud support 116 for distributing cooling air to the shrouds 114 and adjacent structure.

The shroud assembly 110 further includes a plurality of retainer plates 148 (only one shown in FIG. 1) arranged in an annular array and which function to limit aft axial movement of the C-clips 136, thereby eliminating the potential of C-clip disengagement As with other components of the shroud assembly 110, the retainer plates 148 could be formed as a single continuous ring. However, segmented plates are preferred to accommodate thermal expansion.

Figure 2:
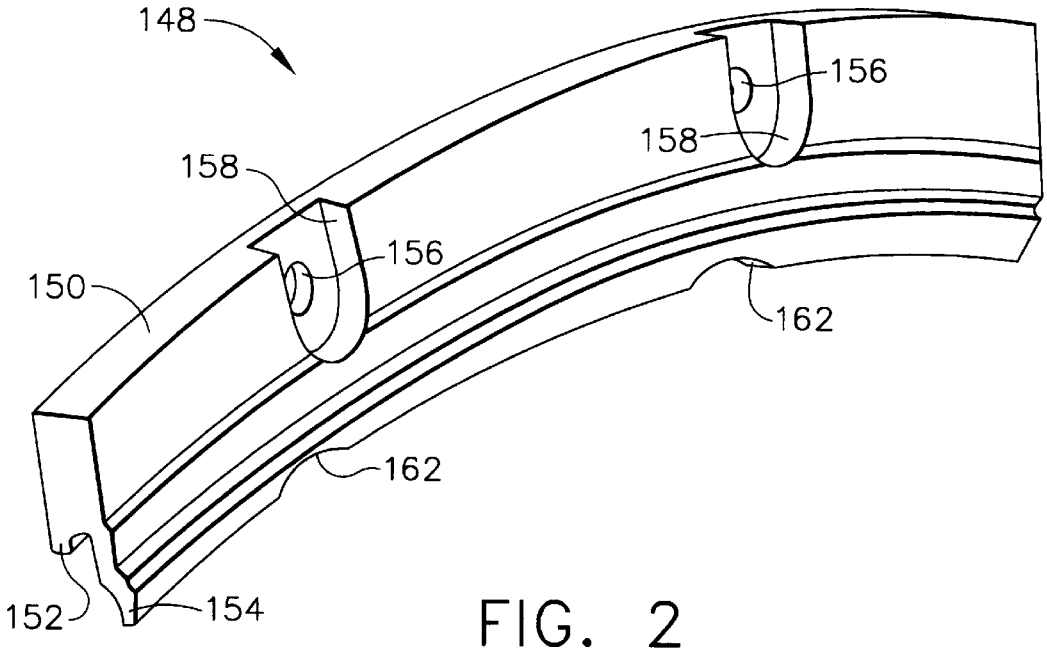
FIG. 2 is an isometric view of a retention plate from the shroud assembly of FIG. 1.

As best seen in FIG. 2, the retainer plate 148 comprises an arcuate body 150 having an interlock lip 152 extending radially inwardly from the forward inner corner thereof and a retaining flange 154 extending radially inwardly from the aft inner corner thereof. A pair of bolt holes 156, with surrounding recesses 158, is formed in the aft face of the arcuate body 150. The retaining flange 154 is provided with an aft lip wear surface 160 on its aft face and one or more clearance slots 162 in its distal edge, both of which are described in more detail below.

Referring again to FIG. 1, the retainer plate 148 is secured to the aft end of the shroud support 116 so that the retaining flange 154 overhangs the back of the C-clip 136 and the interlock lip 152 engages the radial lip 124 formed on the aft flange 122 of the shroud support 116. The retainer plate 148 is positioned such that the retaining flange 154 engages the aft side of the C-clip 136. Preferably, the retainer plate 148 is secured to the shroud support 116 with bolts 164 that extend through bushings 166 disposed in the recesses 158 and the bolt holes 156. The bolts 164 also attach a conventional flow divider 168 to the shroud support 116.

By abutting the back of the C-clip 136, the retaining flange 154 prevents aft axial movement of the C-clip 136. The interlock lip 152 functions to react axial C-clip back-off load, thereby minimizing retainer plate bolt bending stress. The use of the interlock lip 152 also allows a smaller number of bolts 164 to be used. The retainer plates 148 can be sized such that each one engages multiple C-clips. Thus, the total number of retainer plates 148 will be less than the total number of C-clips 136.

The aft lip wear surface 160 provides a contact surface for a leaf seal 170 which is disposed between the shroud assembly 110 and the nozzle outer band 172 of the adjacent stator assembly. The leaf seal 170 is attached to the nozzle outer band 172 by a plurality of circumferentially spaced pins 174 and prevents cooling air from passing between the shroud assembly 110 and the nozzle outer band 172. The clearance slots 162 are circumferentially aligned with the leaf seal pins 174. Thus, in the event the pins 174 travel radially outwardly because of thermal expansion of the nozzle outer band 172, they will be received within the slots 162, thereby avoiding any undesired interference between the pins 174 and the retaining flange 154. The shroud assembly further includes a discourager seal 176 disposed between the radially inner surface of the C-clip 136 and the shrouds 114 for preventing the ingestion of hot gases into the cavity between the C-clip 136 and the nozzle outer band 172.

In addition to eliminating the potential of C-clip disengagement, the shroud assembly 110 of the present invention provides further advantages in that it requires no modification to the shrouds 114, C-clips 136 or shroud hangers 138, and only limited modification of the shroud support 116. Furthermore, the present invention permits simplified lip weld repair because just the retainer plate 148, and not the entire shroud assembly 110, needs to be removed for repair.

Figure 3:
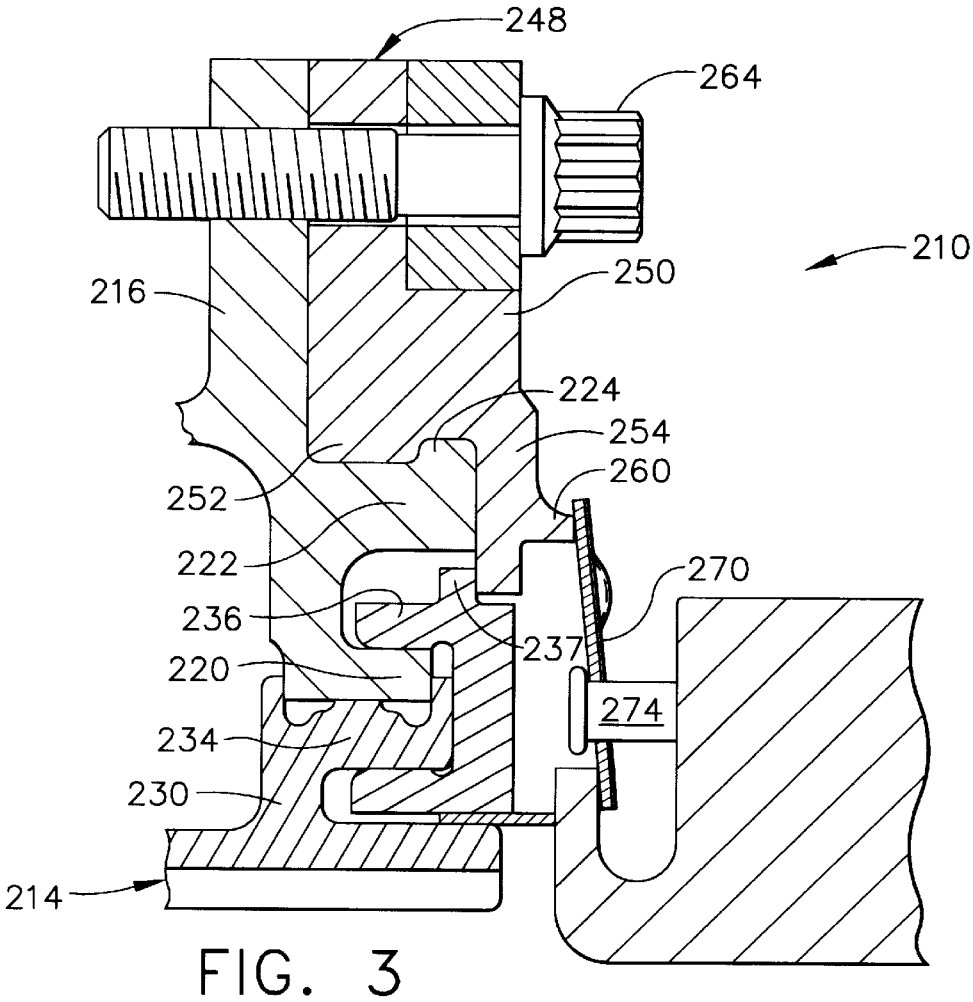
FIG. 3 is a fragmentary sectional view showing a second embodiment of the shroud assembly of the present invention.

Turning to FIG. 3, a shroud assembly 210 in accordance with a second embodiment of the present invention is shown. The shroud assembly 210 is similar to the first embodiment in that it includes a plurality of arcuate shrouds 214 (only one shown in FIG. 3) supported by a shroud support 216. The shroud support 216 has an axially extending aft hook 220 formed on its aft end, and each shroud 214 includes an aft rail 230 from which an aft mounting flange 234 extends rearwardly. The aft mounting flanges 234 of each shroud 214 are juxtaposed with the aft hook 220 and are held in place by a plurality of C-clips 236 which overlap the aft mounting flanges 234 and the aft hook 220 so as to clamp them together.

The shroud assembly 210 further includes a plurality of retainer plates 248 (only one shown in FIG. 3) attached to the aft end of the shroud support 216 by bolts 264. Like the retainer plate 148 of the first embodiment, the retainer plate 248 of the second embodiment comprises an arcuate body 250 having an interlock lip 252 extending radially inwardly from the forward inner corner thereof and a retaining flange 254 extending radially inwardly from the aft inner corner thereof. As before, the interlock lip 252 engages a radial lip 224 formed on the distal end of an aft flange 222 extending from the shroud support 216.

The retainer plate 248 differs from that of the first embodiment in that the retaining flange 254 is configured differently. Instead of overhanging the back of the C-clip 236, the retaining flange 254 terminates at a point radially outside of the C-clip 236. An aft lip wear surface 260 is formed on the aft face of the retaining flange 254 to present a contact surface for a leaf seal 270. A retaining lip 237 is formed on the radially outer surface of the C-clip 236, near its aft side. The retainer plate 248 is positioned on the shroud support 216 so that the retaining flange 254 engages the retaining lip 237. By abutting the back of the retaining lip 237, the retaining flange 254 prevents aft axial movement of the C-clip 236.

By locating the contact point closer to the center of gravity of the retainer plate 248, this embodiment provides for lower retainer plate bending moment, which can be a factor when high axial C-clip back-off loads are involved. Furthermore, because the retaining flange 254 is considerably shorter than that of the first embodiment, clearance between the retainer plate 248 and the leaf spring pins 274 is not an issue. Thus, the retaining flange 254 does not need clearance slots formed therein.

Figure 4:
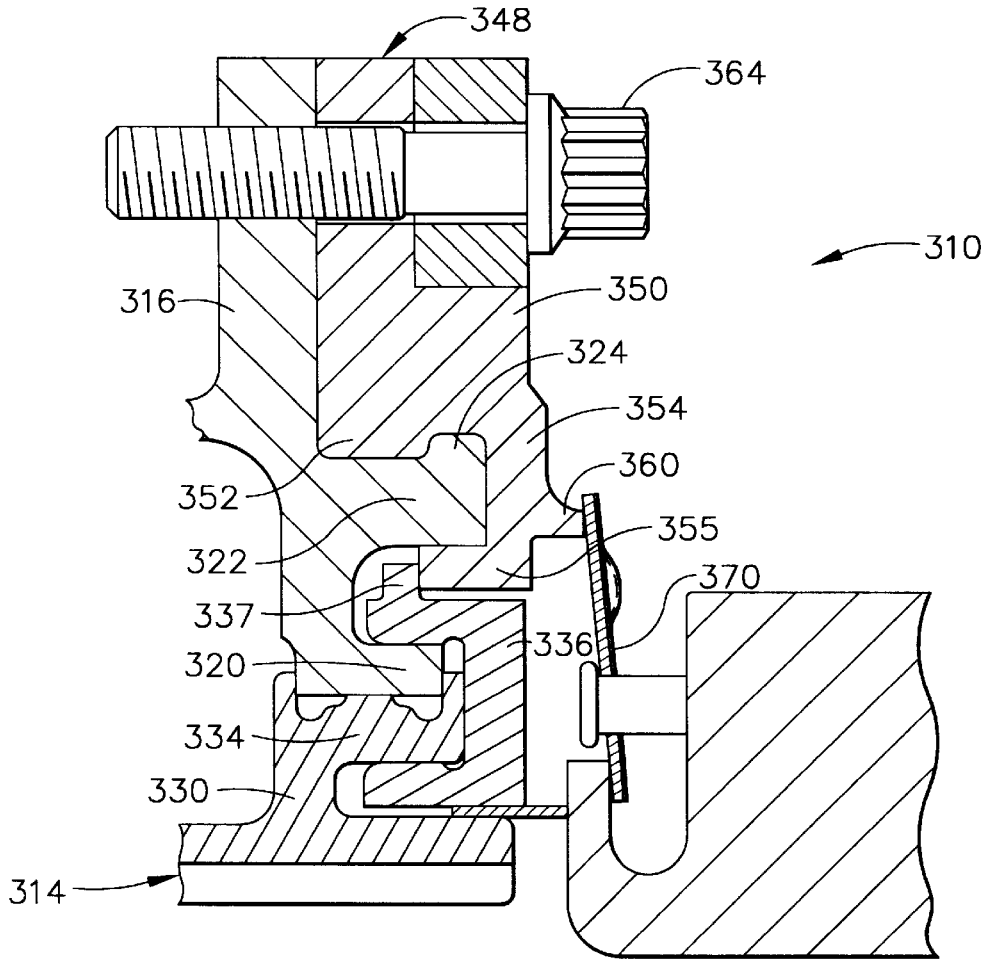
FIG. 4 is a fragmentary sectional view showing a third embodiment of the shroud assembly of the present invention.

Referring to FIG. 4, a shroud assembly 310 in accordance with a third embodiment of the present invention is shown. The shroud assembly 310 is quite similar to that of the second embodiment It includes a plurality of arcuate shrouds 314 (only one shown in FIG. 4) supported by a shroud support 316. The shroud support 316 has an axially extending aft hook 320 formed on its aft end, and each shroud 314 includes an aft rail 330 from which an aft mounting flange 334 extends rearwardly. The aft mounting flanges 334 of each shroud 314 are juxtaposed with the aft hook 320 and are held in place by a plurality of C-clips 336 which overlap the aft mounting flanges 334 and the aft hook 320 so as to clamp them together.

The shroud assembly 310 further includes a plurality of retainer plates 348 (only one shown in FIG. 4) attached to the aft end of the shroud support 316 by bolts 364. Each retainer plate 348 comprises an arcuate body 350 having an interlock lip 352 extending radially inwardly from the forward inner corner thereof and a retaining flange 354 extending radially inwardly from the aft inner corner thereof. As before, the interlock lip 352 engages a radial lip 324 formed on the distal end of an aft flange 322 extending from the shroud support 316.

The retainer plates 348 and C-clips 336 of the third embodiment are slightly different from that of the second embodiment. The retaining flange 354 terminates at a point radially outside of the C-clip 336 and has a forwardly extending abutment lip 355 formed on its distal end. An aft lip wear surface 360 is formed on the aft face of the retaining flange 354 to present a contact surface for a leaf seal 370. A retaining lip 337 is formed on the radially outer surface of the C-clip 336, but unlike the retaining lip 237 of the second embodiment, the retaining lip 337 is located near the forward side of the C-clip 336. The retainer plate 348 is positioned on the shroud support 316 so that the abutment lip 355 engages the retaining lip 337. By abutting the back of the retaining lip 337, the retaining flange 354 prevents aft axial movement of the C-clip 336.

Like the second embodiment, this configuration provides for lower retainer plate bending moment Furthermore, the forward location of the retaining lip 337 greatly reduces the stress impact on the C-clip with respect to the second embodiment.

Figure 5:
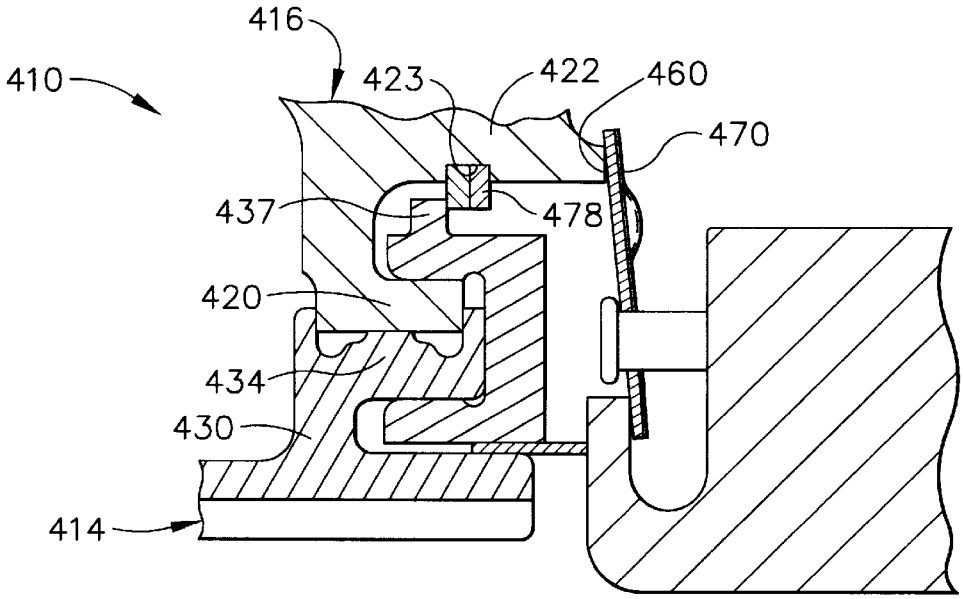
FIG. 5 is a fragmentary sectional view showing a fourth embodiment of the shroud assembly of the present invention.

Turning to FIG. 5, a shroud assembly 410 in accordance with a fourth embodiment of the present invention is shown. As in the previous embodiments, the shroud assembly 410 includes a plurality of arcuate shrouds 414 (only one shown in FIG. 5) supported by a shroud support 416. The shroud support 416 has an axially extending aft hook 420 formed on its aft end, and each shroud 414 includes an aft rail 430 from which an aft mounting flange 434 extends rearwardly. The shroud support 416 also includes an axially extending aft flange 422 disposed at a location radially outside of the aft hook 420. The aft mounting flanges 434 of each shroud 414 are juxtaposed with the aft hook 420 and are held in place by a plurality of C-clips 436 which overlap the aft mounting flanges 434 and the aft hook 420 so as to clamp them together.

An aft lip wear surface 460 is formed on the back side of the aft flange 422 to present a contact surface for a leaf seal 470. A retaining lip 437 is formed on the radially outer surface of the C-clip 436 and is preferably located near the forward side of the C-clip 436. The shroud assembly 410 differs from the previously described embodiments in the type of retainer used. Specifically, the retainer plate is replaced with a split ring 478 disposed within an annular slot 423 formed in the radially inner surface of the aft flange 422. The slot 423 is axially positioned so that the spilt ring 478 engages the back side of the retaining lip 437. The split ring 478 is preferably a 720 degree ring that fits into the slot 423 with a tight tolerance. Thus, the spilt ring 478 is axially fixed with respect to the shroud support 416 and accordingly prevents aft axial movement of the C-clip 436 by virtue of its abutting relationship with the retaining lip 437.

The foregoing has described a shroud assembly having a retainer that eliminates C-clip back-off. While specific embodiments of the present invention have been described, it will be apparent to those skilled in the art that various modifications thereto can be made without departing from the spirit and scope of the invention as defined in the appended claims.

What is claimed is:

1. A shroud assembly comprising:

a shroud support having a hook;

at least one shroud having a mounting flange;

a C-clip overlapping said hook and said mounting flange; and a retainer secured to said shroud support and located so as to engage said C-lip, wherein said retainer prevents aft axial movement of said C-clip.

2. The shroud assembly of claim 1 wherein said retainer comprises a retainer plate having a radially inwardly extending retaining flange that engages said C-clip.

3. The shroud assembly of claim 2 wherein said retaining flange has an aft lip wear surface formed thereon.

4. The shroud assembly of claim 2 wherein said retainer plate has a radially inwardly extending interlock lip and said shroud support has a radially outwardly extending lip, said interlock lip engaging said radially outwardly extending lip.

5. The shroud assembly of claim 2 wherein said retaining flange engages an aft side of said C-clip.

6. The shroud assembly of claim 2 wherein said retaining flange has at least one clearance slot formed therein.

7. The shroud assembly of claim 2 wherein said C-clip has a retaining lip formed on a radially outer surface thereof, said retaining lip engaging said retaining flange.

8. The shroud assembly of claim 7 wherein said retaining lip is located near an aft side of said C-clip.

9. The shroud assembly of claim 7 wherein said retaining lip is located near a forward side of said C-clip, said retaining flange having a forwardly extending abutment lip formed thereon.

10. The shroud assembly of claim 1 wherein said shroud support has an annular slot formed therein and said retainer comprises a split ring disposed in said slot, said split ring engaging said C-clip.

11. The shroud assembly of claim 10 wherein said split ring is a 720 degree ring.

12. The shroud assembly of claim 10 wherein said C-clip has a retaining lip formed on a radially outer surface thereof, said retaining lip engaging said split ring.

13. The shroud assembly of claim 12 wherein said retaining lip is located near a forward side of said C-clip.

14. A shroud assembly comprising:

a shroud support having a hook;

at least one shroud having a mounting flange;

a C-clip overlapping said hook and said mounting flange; and means for preventing aft axial movement of said C-clip.

15. The shroud assembly of claim 14 wherein said means for preventing aft axial movement of said C-clip comprises a retainer plate having a radially inwardly extending retaining flange that engages said C-clip.

16. The shroud assembly of claim 15 wherein said retaining flange has an aft lip wear surface formed thereon.

17. The shroud assembly of claim 15 wherein said retainer plate has a radially inwardly extending interlock lip and said shroud support has a radially outwardly extending lip, said interlock lip engaging said radially outwardly extending lip.

18. The shroud assembly of claim 15 wherein said retaining flange engages an aft side of said C-clip.

19. The shroud assembly of claim 15 wherein said retaining flange has at least one clearance slot formed therein.

20. The shroud assembly of claim 15 wherein said C-clip has a retaining lip formed on a radially outer surface thereof, said retaining lip engaging said retaining flange.

21. The shroud assembly of claim 20 wherein said retaining lip is located near an aft side of said C-clip.

22. The shroud assembly of claim 20 wherein said retaining lip is located near a forward side of said C-clip, said retaining flange having a forwardly extending abutment lip formed thereon.

23. The shroud assembly of claim 14 wherein said shroud support has an annular slot formed therein and said means for preventing aft axial movement of said C-clip comprises a split ring disposed in said slot, said split ring engaging said C-clip.

24. The shroud assembly of claim 23 wherein said split ring is a 720 degree ring.

25. The shroud assembly of claim 23 wherein said C-clip has a retaining lip formed on a radially outer surface thereof, said retaining lip engaging said split ring.

26. The shroud assembly of claim 25 wherein said retaining lip is located near a forward side of said C-clip.

27. A shroud assembly for a gas turbine engine having a turbine rotor carrying a plurality of turbine blades, said shroud assembly comprising:

an annular shroud support, said shroud support having an axially extending aft hook formed thereon;

a plurality of shrouds arranged in an annular array to encircle said turbine blades, each one of said shrouds including a base having an aft rail extending outwardly therefrom, said aft rail having a mounting flange formed thereon;

a plurality of C-clips overlapping said aft hook and said mounting flanges for clamping said shrouds to said shroud support; and at least one retainer secured to said shroud support and engaging said C-clips so as to prevent aft axial movement of said C-clips.

28. The shroud assembly of claim 27 wherein said at least one retainer comprises a plurality of retainer plates, each retainer plate having a radially inwardly extending retaining flange that engages an aft side of at least one C-clip, and a radially inwardly extending interlock lip that engages a radially outwardly extending lip formed on said shroud support.

29. The shroud assembly of claim 27 wherein each one of said C-clips has a retaining lip formed on a radially outer surface thereof, near an aft side thereof, and wherein said at least one retainer comprises a plurality of retainer plates, each retainer plate having a radially inwardly extending retaining flange that engages at least one of said retaining lips, and a radially inwardly extending interlock lip that engages a radially outwardly extending lip formed on said shroud support.

30. The shroud assembly of claim 27 wherein each one of said C-clips has a retaining lip formed on a radially outer surface thereof, near a forward side thereof, and wherein said at least one retainer comprises a plurality of retainer plates, each retainer plate having a radially inwardly extending retaining flange, a forwardly extending abutment lip that engages at least one of said retaining lips formed on said retaining flange, and a radially inwardly extending interlock lip that engages a radially outwardly extending lip formed on said shroud support.

31. The shroud assembly of claim 27 wherein said shroud support has an annular slot formed therein, wherein each one of said C-clips has a retaining lip formed on a radially outer surface thereof, and wherein said at least one retainer comprises a split ring disposed in said slot, said split ring engaging said retaining lips.

32. In a shroud assembly comprising a shroud support having a hook, at least one shroud having a mounting flange and a C-clip,overlapping said hook and said mounting flange, a method of preventing aft axial movement of said C-clip, said method comprising:

placing a retainer in engagement with said C-clip, such that said retainer blocks aft axial movement of said C-clip; and securing said retainer to said shroud support.

33. The method of claim 32 wherein the step of securing said retainer to said shroud support comprises bolting said retainer to said shroud support.

34. The method of claim 32 wherein the step of securing said retainer to said shroud support comprises disposing said retainer in a slot formed in said shroud support.

* * * * *